United States Patent [19]

Kawada

[11] 4,154,386

[45] May 15, 1979

[54] AUTOMATIC PAPER-PASSING APPARATUS IN TURNING BARS IN ROTARY PRESS

[75] Inventor: Tomoshi Kawada, Kawasaki, Japan

[73] Assignee: Kabushiki Kaisha Tokyo Kikai Seisakusho, Tokyo, Japan

[21] Appl. No.: 817,525

[22] Filed: Jul. 20, 1977

[30] Foreign Application Priority Data

Dec. 29, 1976 [JP] Japan ..... 51-160667

[51] Int. Cl.[2] ..... B65H 17/34; B65H 23/32

[52] U.S. Cl. ..... 226/91; 226/96; 226/171; 226/197; 101/223

[58] Field of Search ..... 226/197, 91, 92, 96, 226/171; 101/222, 223

[56] References Cited

U.S. PATENT DOCUMENTS

| | | | |
|---|---|---|---|
| 344,352 | 6/1886 | Crowell | 226/197 |
| 3,125,335 | 3/1964 | Becker | 226/91 X |
| 4,063,505 | 12/1977 | Sasamoto | 226/91 X |

*Primary Examiner*—Richard A. Schacher

[57] ABSTRACT

A fixed guide plate is disposed on one side along a paper passage before and after turning bars, and a circulating running belt is disposed on the other side along said paper passage, so that the front end of running paper is fed in the state gripped therebetween; in each turning bar, the end portion of said guide plate is curved along the peripheral face of the turning bar with a clearance corresponding to the paper thickness, so that the front end of running paper is guided by said curved portion; and an endless belt from which a sticking plate projects toward the paper running passage is made to stand by at the point where the front end of running paper separates from the final turning bar, so that the top of running paper is stuck to the sticking plate of the endless belt and withdrawn from the turning bar mechanism; or, in each turning bar, flanged pins are planted on the side face of the circulating running belt, and a female type rail curved along the peripheral face of the turning bar with a clearance corresponding to the paper thickness is supported at the top end of an arm, so that while the flanged pins are hung down and slidingly guided in succession by said female type rail, the course of said circulating running belt is turned by 90° along the peripheral face of the turning bar and the front end of running paper is advanced with said circulating running belt and is turned around the turning bar.

13 Claims, 5 Drawing Figures

AUTOMATIC PAPER-PASSING APPARATUS IN TURNING BARS IN ROTARY PRESS

BACKGROUND OF THE INVENTION

The present invention relates to a completely automatic apparatus for passing paper through two turning bars disposed at an angle of 45° to the paper running direction in a rotary press.

In the conventional mechanism including one turning bar, since the structure is relatively simple, the paper-passing operation can be performed relatively easily by fingers. However, in case of a double turning bar mechanism including two turning bars disposed in parallel to each other at an angle of 45° to the paper running direction for piling two sheets of paper which are running adjacently to each other or in case of a double turning bar mechanism including two turning bars disposed rectangularly to each other at an angle of 45° to the paper running direction for turning the paper running direction by 180°, the structure is complicated and the paper-passing course is readily mistaken. Further, since in order to facilitate the paper-passing operation, the front end portion of running paper is obliquely cut to form a sharp tapered front end, paper is readily broken in the front end portion when the sharp tapered front end is pulled. Moreover, since the turning bars are non-moving members, paper is readily shifted in the lateral direction or readily broken by the frictional force of the turning bars. Accordingly, a long-experienced skill is required for passing paper safely by picking the front end of paper between fingers and reducing the operation speed of the machine discontinuously. Namely, this paper-passing operation requires much labor and a long time. Especially in printing of news papers, promptness of information is greatly checked by this operation.

There is known a technique of guiding the front end of paper to the point just before turning bars by an endless belt of the straight advancing type. According to this technique, however, since the endless belt does not arrive at a turning portion important for turning paper around turning bars and passing paper therethrough, troubles such as jamming are readily caused when paper is turned around the turning bars, and automation of the paper-passing operation is obstructed by such troubles.

It is therefore a primary object of the present invention to create and provide an apparatus for performing the paper-passing operation completely automatically in the turning bar mechanism, in which the operation of turning paper around turning bars and passing it therethrough can be performed highly assuredly and very smoothly and rapidly without occurrence of troubles such as lateral paper shifting, paper breakage and jamming.

SUMMARY OF THE INVENTION

One of the characteristic features of the present invention resides in that a fixed guide plate is disposed on one side along a paper passage before and after turning bars and a circulating running belt is disposed on the other side along said paper passage to confront the fixed guide plate, so that the front end of running paper is fed in the state gripped between said guide plate and said circulating running belt; in each turning bar, the end portion of said guide plate is curved along the peripheral face of the turning bar with a clearance corresponding to the paper thickness being formed therebetween, so that the front end of running paper is guided by said curved portion and the course of running paper is turned by 90° along the peripheral face of the turning bar; and an endless belt from which a sticking plate projects, toward the paper running passage is made to stand by at the point where the front end of running paper separates from the final turning bar, so that the top end of running paper which has passed through the final turning bar is stuck to the sticking plate of the endless belt and withdrawn from the turning bar mechanism to a subsequent mechanism.

Another characteristic feature of the present invention resides in that flanged pins of the same shape are planted in a line along the running direction at prescribed intervals on the side face of the circulating running belt that has no contact with the paper face; and a female type rail curved along the peripheral face of the turning bar with a clearance corresponding to the paper thickness being formed therebetween is supported and fixed to the top end of an arm, so that while the flanged pins planted on said circulating running belts are hung down and slidingly guided in succession by said female type rail, the course of said circulating running belt is turned by 90° along the peripheral face of the turning bar and the front end of running paper is advanced with said circulating running belt and is turned around the turning bar.

DESCRIPTION OF THE PREFERRED EMBODIMENT

Figure 1:
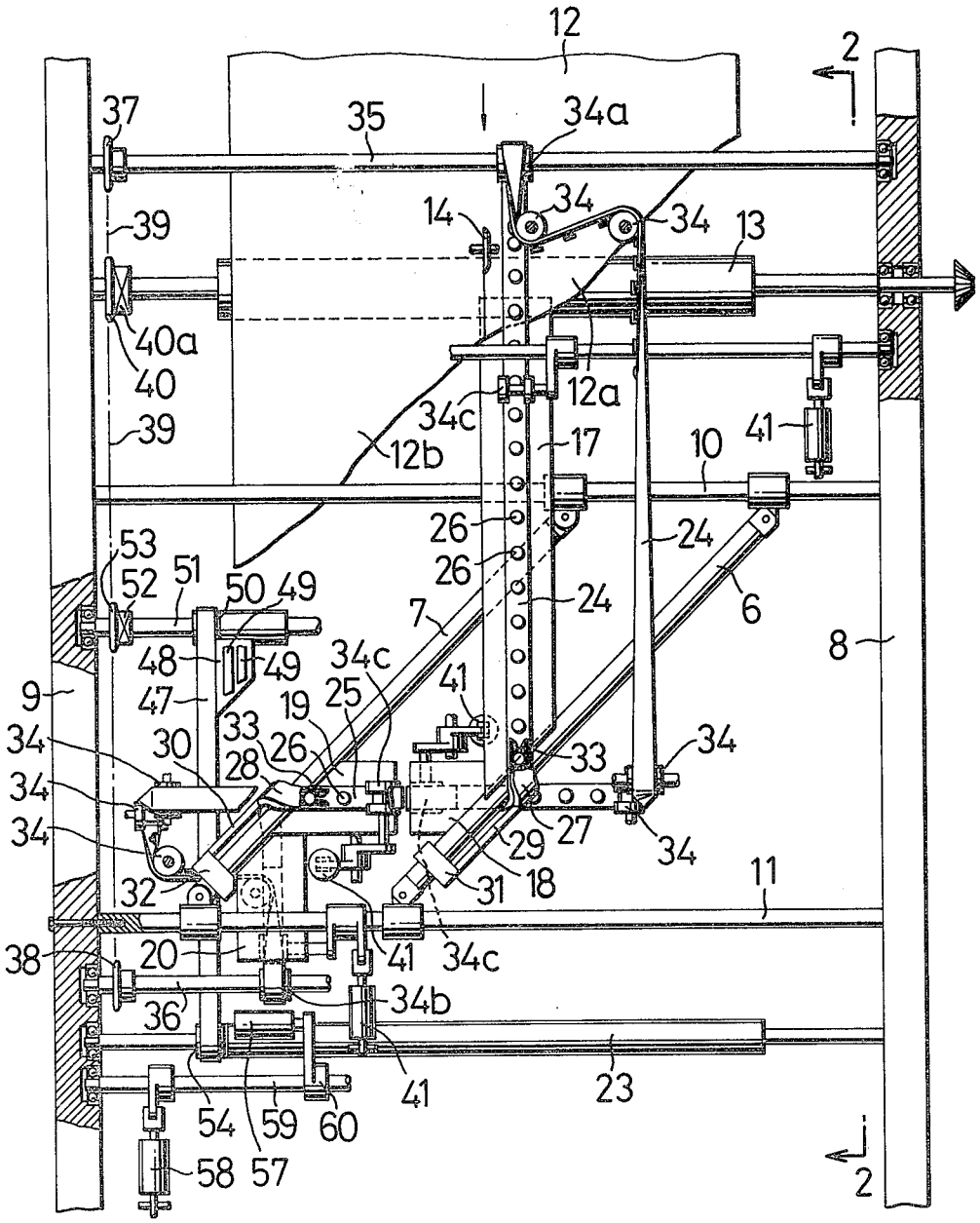
FIG. 1 is a plan view illustrating one embodiment of the present invention.

The structure of the present invention will now be described in detail by reference to embodiments illustrated in the accompanying drawings.

In each of double turning bar mechanisms shown in FIGS. 1 and 4, a pair of turning bars 6 and 7 are disposed in parallel to each other at an angle of 45° to running paper for piling two sheets of paper running side by side by transferring one of the two sheets above or below the other sheet. Both ends of each of the turning bars 6 and 7 are attached and fixed to a pair of supporting shafts 10 and 11 laid out between left and right frames 8 and 9 so that each turning bar is not rotated. As shown in FIG. 2, the first turning bar 6 is located above the next bar 7 by a distance corresponding to the diameter of the turning bar.

Running paper 12 is first delivered to a drag roll 13 while it retains a broad width covering both the turning bars 6 and 7, and it is cut into halves in the longitudinal direction by a rotary cutter 14 located above the drag roll 14 at the center thereof. Thus, the running paper 12 is divided into running papers 12*a* and 12*b* having the same width that corresponds to ½ of the original broad width. As shown in FIGS. 1 and 4, the front end of each of the running papers 12*a* and 12*b* equal to the inclination angle of the turning bars, namely 45°.

In the embodiments illustrated in the drawings, one running paper 12*a* is piled on the surface of the other running paper 12*b* using the turning bar mechanism. Accordingly, as shown in FIG. 2, after passage through the drag roll 13 the other running paper 12*b* separates downwardly from the turning bar mechanism and arrives at a final guide roll 16 through a guide roll 15, and by this final guide roll 16 the running paper 12*b* is joined with and piled on the running paper 12*a* which has passed through the turning bar mechanism.

Figure 2:
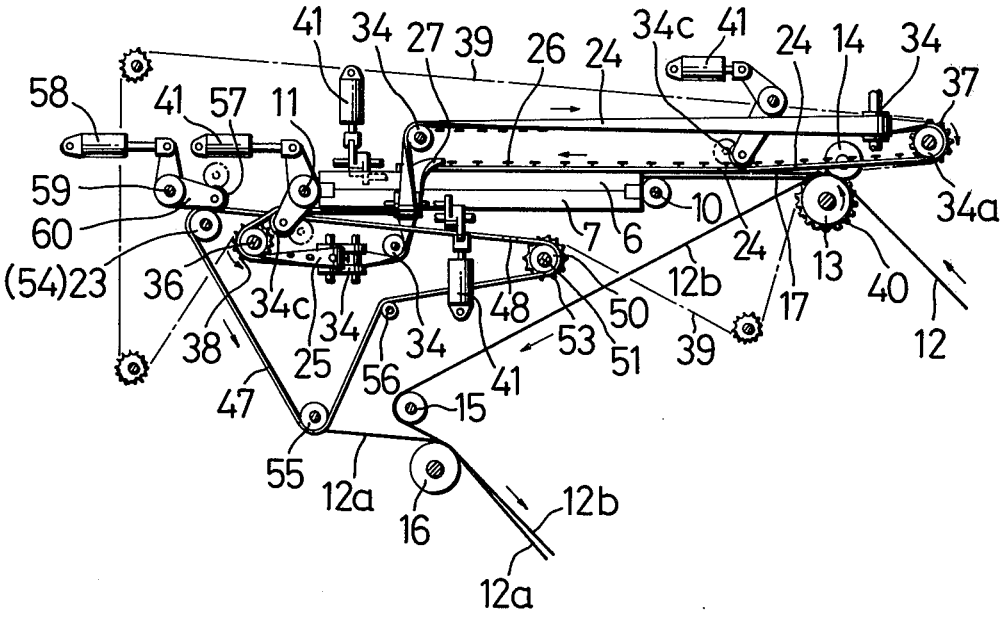
FIG. 2 is a view showing the right-side section taken along the line 2—2 in FIG. 1.

In FIG. 1, guide plates 17, 18, 19 and 20 are disposed on one side of a passage of paper before and after the turn bars, namely a passage on which the sharp tapered front end of the running paper 12*a* is to run. The guide plate 17 guides the lower side of the running paper 12*a* between the drag roll 13 and the first turning bar 6, and the guide plate 18 guides the upper side of the running paper 12*a* from the turning bar 6 to the point intermediate between the two turning bars 6 and 7. The guide plate 19 guides the lower side of the running paper 12*a* from the point intermediate between the two running bars to the second turning bar 7, and the guide plate 20 guides the upper side of the running paper 12*a* after passage through the second turning bar 7.

Figure 4:
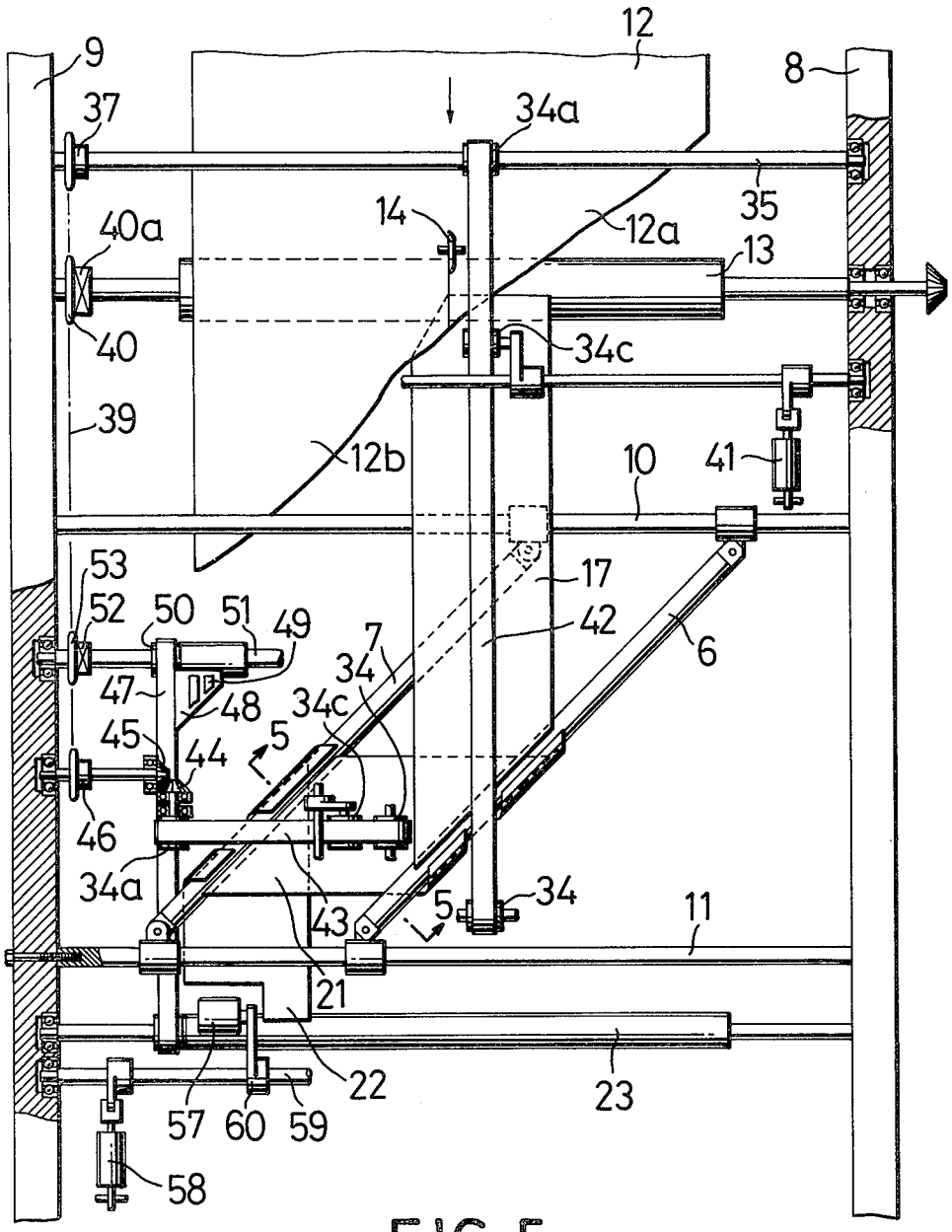
FIG. 4 is a plan view illustrating another embodiment of the present invention.
Figure 5:
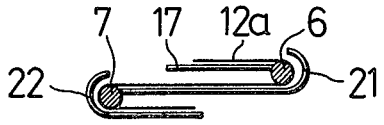
FIG. 5 is a view showing the section taken along the line 5—5 in FIG. 4.

Among guide plates in the embodiment shown in FIG. 4, only the first guide plate 17 is the same as that in the embodiment shown in FIG. 1, but other guide plates are different from those shown in FIG. 1. More specifically, as shown in FIG. 5, one end of a guide plate 21 is curved upwardly along the peripheral face of the first turning bar 6 with a clearance corresponding at least to the paper thickness being formed therebetween, and the other end extends onto the second turning bar 7. One end of a guide plate 22 is upwardly curved along the peripheral face of the second turning bar 7 with a clearance corresponding at least to the paper thickness being formed therebetween, and the other end extends onto a guide roll 2. Each of these guide plates 17, 21 and 22 guides the lower side of the running paper 12*a*.

Figure 3:
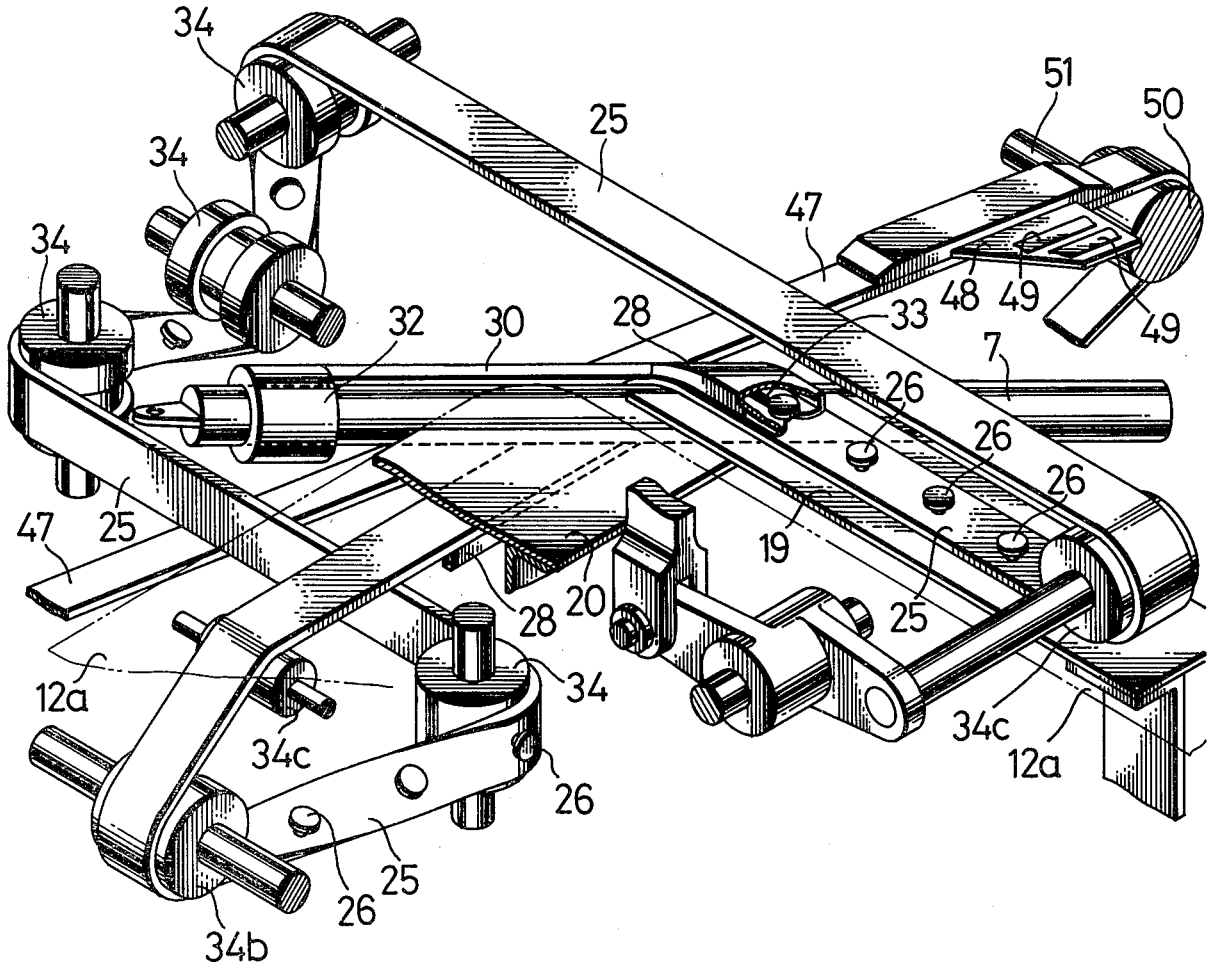
FIG. 3 is a perspective view showing a left lower portion of FIG. 1.

In FIGS. 1 and 2, one circulating running belt 24 is arranged so that it can run along the guide plates 17 and 18 while turning the course by 90° and the other circulating belt 25 is arranged so that it can run along the guide plates 19 and 20 while turning the course by 90°. In order to realize the above feature, flanged pins 26 of the same shape are planted in a line at prescribed intervals on the side faces of the circulating running belts 24 and 25 that are not contacted with the paper surface and female type rails 27 and 28 curved along the peripheral faces of the turning bars 6 and 7, respectively, with a clearance corresponding to the paper thickness being formed between each rail and each peripheral face, are supported and fixed to the top ends of arms 29 and 30, respectively. The base end portions of the arms 29 and 30 are supported by brackets 31 and 32 attached to the ends of the respective turning bars 6 and 7. Each of the female type rails 27 and 28 is a cylindrical member having in the inside thereof a slit 33 extending along the running direction of the belt 24 as shown in FIG. 3 on an enlarged scale. When the flange portion of the flanged pin 26 planted on the belt 24 is put into the cylinder, the flange portion of the pin 26 is caught by the female rail 28 and the pin 26 is hung down therefrom and in this state the belt 24 is slidingly divided. Accordingly, even if the course of the belt 24 is turned by 90° in the turning bar 7, it can run on the prescribed course without side slipping.

A number of pulleys 34 are disposed at appropriate positions to guide the circulating running belts 24 and 25. Pulleys 34*a* and 34*b* are disposed to drive the belts 24 and 25, respectively. The driving pulleys 34*a* and 34*b* are rotated synchronously with the paper-passing speed in the printing machine by a sprocket 40 provided with an electromagnetic clutch 40*a* and mounted on the shaft end of the drag roll 13 through a chain 39 engaged with sprockets 37 and 38 mounted on the ends of shafts 35 and 36 of said pulleys 34*a* and 34*b*. Pulleys 34*c* disposed in the introduction zone where the belts 24 and 25 fall in contact with the running paper 12*a* and in the discharge zone where the running paper 12*a* separates from these belts are arranged so that they are brought close to the running paper 12*a* and are separated from the running paper 12*a* by the action of an air cylinder 41. Namely, the pulleys 34*c* are brought close to the running paper at the paper-passing operation, and they are separated from the running paper while the running paper is travelled in a full scale, so that running of the paper is not obstructed by these pulleys. On the periphery of each pulley 34, a concave groove is formed only in the portion on which the flanged pin 26 hits.

In the embodiment shown in FIG. 4, a pair of circulating running belts 42 and 43 are constructed by a simple endless belt. One belt 42 is disposed so that it it linearly advanced along the guide plate 17 while having contact with the upper side thereof, and the other belt 43 is linearly advanced along the guide plate 21 while having contact with the upper side thereof. A driving power is transmitted to the driving pulley 34 of the other belt 43 from the chain 39 engaged with a sprocket 46 through bevel gears 44 and 45.

In FIGS. 1 and 4, even after the front end of the running paper 12*a* has passed through the final turning bar 7 and discharged from the turning bar system, the substantial portion of the width of the running paper 12 has not yet been completely discharged from the turning bar system. Accordingly, it is necessary to further pull out the discharge front end of the running paper 12*a* automatically, and it is desired to join the sufficiently pulled-out paper 12*a* with the other running paper 12*b* and deliver them in the piled state to a subsequent mechanism, for example, a folding zone. As means for realizing this feature, an endless belt 47 is disposed along the outside of the position where the front end of the running paper 12*a* which has passed through the final turning bar 7 is discharged and a sticking plate 48, for example, a triangular flexible plate on which a both-surface-adhesive tape 49 is applied, is projected from one point on the belt 47 toward the paper running passage. Namely, the base portion of the sticking plate 48 is sewn on the belt 47. The belt 47 is made to stand by at a position indicated in the drawings. A sprocket 53 is mounted through an electromagnetic clutch 52 on the end of a shaft 51 of a pulley 50 for driving the belt 47, and the chain 39 is engaged with the sprocket 53 so that it is always turned. When the front end of the running paper passes through the final turning bar 7, the passage is detected by a micro-switch or photoelectric apparatus (not shown) and by signals of such detecting means, the electromagnetic clutch 52 is actuated to transmit the power to the driving pulley 50 from the sprocket 53 to move the endless belt 47. The endless belt 47 is brought down through a guide pulley 54 disposed coaxially with the guide roll 23, and as shown in FIG. 2, it then passes through the lower guide pulleys 55 and 56 and returns to the position of the driving pulley 50.

A rubber roller 57 is disposed so that it is allowed to have pressing contact with the guide roller 23. A swinging arm 60 is fixed to a shaft 59, and by the action of the swinging arm 60 operated by an air cylinder 58, the rubber roller 57 is pressed onto the guide roller 23 when the front end of the running paper 12*a* passes just through the position of the sticking plate 48 in the piled state. At other time, the rubber roller 57 is made to stand by at a remote position.

Actions and functions in the apparatus of the present invention are as follows:

Running paper 12 having a broad width, which has been delivered to the drag roll 13, is advanced at a low speed enabling the paper-passing operation by the rotation of the sprocket 40 transmitted to the drag roll 13 by suitable engagement of the electromagnetic clutch 40*a*. By the rotation of the drag roll 13, the rotary cutter 14 on the roller 13 is actuated to cut the running paper 12 having a broad width at the center thereof into two equal halves, namely running paper 12*a* and running 12*b*.

Running paper 12*b* having a width diminished to ½ of the original width by cutting is not introduced into the turning bar mechanism but passes below the turning bar system and arrives at the final guide roll 16 through the guide roll 15. This final guide roll 16 is located at the point where one running paper 12*a* that has passed through the turning bar mechanism is combined with the other running paper 12*b* and piled thereon.

The front end of the running paper 12*a* having a width reduced to ½ of the original width by cutting is brought close to the guide plate 17 in the introduction zone by the action of the cylinder 41 and inserted between the circulating running belt 24 guided and advanced by the pulley 34*c* and the guide plate 17. Thus, the front end of the running paper 12*a* is kept in the state gripped between the belt 24 and the guide plate 17.

By the driving power transmitted through the chain 39, sprocket 37, shaft 35 and driving pulley 34*a*, the circulating running belt 24 is moved along the running direction of the running paper 12*a*. Accordingly, the front end of the running paper 12*a* is guided onto the first turning bar 6.

In the embodiment illustrated in FIGS. 1 to 3, flanged pins 26 are aligned on the side face of the belt 24 that is not contacted with the running paper 12*a* and the female type rail 27 curved along the peripheral face of the turning bar 6 with a clearance corresponding to the paper thickness being formed is fixed. Accordingly, the flanged pins 26 of the belt 24 are inserted into the slit 33 of the female type rail 27 in succession and the belt 24 is slidingly guided in the state where the pins 26 are hung down from the rail 27, whereby the course of the belt 24 is turned by 90° without lateral shifting on the peripheral face of the turning bar 6. Accordingly, the front end of the running paper 12*a* is moved together with the belt 24 slidingly guided by the female type rail 27 to turn its course by 90°, whereby also the course of the running paper 12*a* is turned by 90° on the peripheral face of the turning bar 6. Then, the front end of the running paper 12*a* is discharged along the next guide plate 18.

The front end of the running paper which has turned around the first turning bar 6 and discharged from between the guide plate 18 and belt 24 is gripped between the second circulating running belt 25 and the guide plate 19 so that it will turn around the second turning bar 7.

By the cooperative function of the belt 25 having special flanged pins 26 aligned thereon and the female type rail 28, as shown in FIG. 3, the front end of the running paper 12*a* is allowed to turn along the peripheral face of the turning bar 7 and pass through it in the same manner as it has turned around and passed through the first turning bar 6.

In the embodiment shown in FIGS. 4 and 5, since the belts 42 and 43 are ordinary belts have a simple structure, in the first and second turning bars 6 and 7 the front end of the running paper 12*a* is turned along the ends of the curved guide plates 21 and 22 so that the course is turned by 90°.

In the embodiments shown in FIGS. 1 and 4, when the front end of the running paper 12*a* has just passed through the final turning bar 7, by a detection signal emitted by a micro-switch or photoelectric apparatus (not shown), the electromagnetic clutch 52 is actuated to transmit the power from the sprocket 53 to the endless belt 47 through the shaft 51 and driving pulley 50, whereby the belt 47 is moved. The plate 48 having the adhesive tape 49 applied thereon, which is projected from the belt 47 in the sideway, is combined with the front end of the running paper 12*a* which has passed through the turning bar 7, and it is moved together with the front end of the running paper 12*a* and arrives at the guide roll 23. Since the rubber roll 57 is pressed down onto the guide roll 23 by the action of the air cylinder 58, the front end of the running paper 12*a* is press-bonded to the sticking plate 48. Accordingly, the front end of the running paper 12*a* is moved by running of the belt 47 in the state closely stuck to the sticking plate 48, and as shown in FIG. 2, the front end of the running paper 12*a* passes through the guide pulley 55 and is combined with the other running paper 12*b* at the position of the final guide roll 16.

When the operation of passing paper through the turning bars 6 and 7 is completed, the circulating running belts 24 and 25 and position-variable pulleys 34*c* located in the introduction and discharge zones 42 and 43 are returned to the positions remote from the respective guide plates by the action of the air cylinder 41. Further, the electromagnetic clutches 40*a* and 52 are de-energized, and all the functions of the automatic paper-passing apparatus of the present invention are stopped and a high speed operation in a full scale is performed by a different driving system. During this high speed operation, the respective guide plates and circulating running belts are located above or below the paper passage and they do not interfere with running of paper. Accordingly, troubles such as paper breakage are not caused at all.

In the present invention, a procedure in which only the sharp tapered front end of the running paper 12*a* having a very low resistance to the pulling force is pulled is not adopted, but the front end of the running paper 12*a* is guided and moved in such a manner that one side of the sharp tapered front end portion of the running paper 12*a* is entirely gripped between the guide plate and circulating running belt along a relatively broad region in the longitudinal direction. Especially when paper is turned around and passed through the turning bars 6 and 7, in the embodiment shown in FIGS. 1 to 3, by the cooperative action of the belts 24 and 25 provided with special flanged pins 26 and the female type rails 27 and 28, the paper is moved together with the belts and its course is changed by 90° along the turning bars while the courses of the belts are turned by 90° along the turning bars. In the embodiment shown in FIGS. 4 and 5, by the action of the ends of the guide plates curved along the turning bars, the front end of the running paper 12*a* is skillfully guided and its course is turned by 90° automatically. When the front end of the running paper 12*a* passes through the final turning bar 7 and is discharged from the turning bar mechanism, the sticking plate 48 projected from the endless belt 47 disposed in the sideway of the running paper 12*a* is moved together with the front end of the running paper 12*a* so that the front end of the running paper 12*a* is combined with the sticking plate 48. The front end of the running paper 12*a* is stuck to the sticking plate 48 by the pressing action of the rubber roller 57, and in this state, the front end of the running paper 12*a* is delivered to a subsequent mechanism, for example, the folding zone.

As is seen from the foregoing illustration, the paper-passing operation in the double turning bar mechanism, which has heretofore been performed manually, can be performed completely automatically in the present invention. Further, such troubles as lateral shifting of paper, paper breakage and jamming are not caused at all, and the paper-passing operation can be accomplished very smoothly and rapidly. Therefore, the present invention makes great industrial contributions, especially to the art of news paper printing in which promptness of information is required.

What is claimed is:

1. An automatic paper-passing apparatus in turning bars in a rotary press, characterized in that a fixed guide plate is disposed on one side along a paper passage before and after turning bars and a circulating running belt is disposed on the other side along said paper passage to confront the fixed guide plate, so that the front end of running paper is fed in the state gripped between said guide plate and said circulating running belt; in each turning bar, the end portion of said guide plate is curved along the peripheral face of the turning bar with a clearance corresponding to the paper thickness being formed therebetween, so that the front end of running paper is guided by said curved portion and the course of running paper is turned by 90° along the peripheral face of the turning bar; and an endless belt having a sticking plate projected toward the paper running passage is made to stand by at the point where the front end of running paper separates from the final turning bar, so that the top end of running paper which has passed through the final turning bar is stuck to the sticking plate of the endless belt and withdrawn from the turning bar mechanism to a subsequent mechanism.

2. An automatic paper-passing apparatus in turning bars in a rotary press according to claim 1 wherein the circulating running belt and the guide plate are disposed along the passage on which a sharp tapered front end of paper cut obliquely with respect to the paper width direction is to run.

3. An automatic paper-passing apparatus in turning bars in a rotary press according to claim 1 wherein a pulley is disposed in the introduction zone where the circulating running belt falls in contact with running paper and another pulley is disposed in the discharge zone where the circulating running belt separates from running paper, so that positions of the respective pulleys can be changed in the direction coming close to and separating from running paper.

4. An automatic paper-passing apparatus in turning bars in a rotary press according to claim 1 wherein the sticking plate is a plate having a both-surface-adhesive tape applied to the top face thereof.

5. An automatic paper-passing apparatus in turning bars in a rotary press according to claim 1 wherein the belt mechanism including the sticking plate is disposed so that the sticking plate runs in a direction merged obliquely from below in the course on which the sharp tapered front end of running paper is to run after passage through the turning bar mechanism.

6. An automatic paper-passing apparatus in turning bars in a rotary press according to claim 1 in which said two turning bars are disposed in parallel to each other at an angle of 45° to the paper running direction.

7. An automatic paper-passing apparatus in turning bars in a rotary press, characterized in that a fixed guide plate is disposed on one side along a paper passage before and after turning bars and a circulating running belt is disposed on the other side along said paper passage to confront the fixed guide plate, and flanged pins of the same shape are planted in a line along the running direction at prescribed intervals on the side of the circulating running belt that has no contact with the paper face, so that the front end of running paper is fed in the state gripped between said guide plate and said circulating running belt; in each turning bar, an arm is projected from a bracket attached to the end portion of the turning bar to the running passage of said belt, and a female type rail curved along the peripheral face of the turning bar with a clearance corresponding to the paper thickness being formed therebetween is fixed to the top end of said arm, so that while the flanged pins planted on said circulating running belts are hung down and slidingly guided in succession by said female type rail, the course of said circulating running belt is turned by 90° along the peripheral face of the turning bar, and the front end of running paper is advanced with said circulating running belt and the course thereof is turned by 90° along the peripheral face of the turning bar; and an endless belt having a sticking plate projected toward the paper running passage is made to stand by at the point where the front end of running paper separates from the final turning bar, so that the front end of running paper which has passed through the final turning bar is stuck to the sticking plate of the endless belt and withdrawn from the turning bar mechanism to a subsequent mechanism.

8. An automatic paper-passing apparatus in turning bars in a rotary press according to claim 7 wherein a pulley is disposed to guide the circulating running belt having flanged pins planted on one side face thereof and a concave groove is formed on the peripheral face of the pulley only in the portion on which said pins hit.

9. An automatic paper-passing apparatus in turning bars in a rotary press according to claim 2 wherein the circulating running belt and the guide plate are disposed along the passage on which a sharp tapered front end of paper cut obliquely with respect to the paper width direction is to run.

10. An automatic paper-passing apparatus in turning bars in a rotary press according to claim 2 wherein a pulley is disposed in the introduction zone where the circulating running belt falls in contact with running paper and another pulley is disposed in the discharge zone where the circulating running belt separates from running paper, so that positions of the respective pulleys can be changed in the direction coming close to and separating from running paper.

11. An automatic paper-pressing apparatus in turning bars in a rotary press according to claim 7 wherein the sticking plate is a plate having a both-surface-adhesive tape applied to the top face ther.

12. An automatic paper-passing apparatus in turning bars in a rotary press according to claim 7 wherein the belt mechanism including the sticking plate is disposed so that the sticking plate runs in a direction merged obliquely from below in the course on which the sharp tapered front end of running paper is to run after passage through the turning bar mechanism.

13. An automatic paper-passing apparatus in turning bars in a rotary press according to claim 2 in which said two turning bars are disposed in parallel to each other at an angle of 45° to the paper running direction.

* * * * *